US005485656A

United States Patent [19]

Domenig

[11] Patent Number: 5,485,656

[45] Date of Patent: Jan. 23, 1996

[54] HINGE FOR MOUNTING A DOOR ON A FRAME

[75] Inventor: Georg Domenig, Kernersville, N.C.

[73] Assignee: Grass America, Inc., Kernersville, N.C.

[21] Appl. No.: 288,446

[22] Filed: Aug. 10, 1994

[51] Int. Cl.[6] ..... E05D 5/02

[52] U.S. Cl. ..... 16/387; 16/248

[58] Field of Search ..... 16/248, 249, 237, 16/236, 389, 390, 391, 392, 387

[56] References Cited

U.S. PATENT DOCUMENTS

| | | | |
|---|---|---|---|
| 2,973,547 | 3/1961 | Heyer | 16/392 |
| 3,577,584 | 5/1971 | Himelreich | 16/390 |
| 4,290,167 | 9/1981 | Lautenschlager | 16/249 |
| 4,554,706 | 11/1985 | Rock et al. | 16/248 |
| 5,375,297 | 12/1994 | Lautenschlager et al. | 16/249 |
| 5,412,841 | 5/1995 | Lautenschlager et al. | 16/249 |

*Primary Examiner*—P. Austin Bradley
*Assistant Examiner*—Chuck Y. Mah
*Attorney, Agent, or Firm*—Petree Stockton L.L.P.

[57] ABSTRACT

A hinge for mounting a door on a frame includes a hinge arm receiver and a hinge arm connected at one end to the hinge arm receiver and having at its other end a hinge plate with a depending ledge having a terminus portion which is engageable in a pre-mounting position on a door or frame.

6 Claims, 2 Drawing Sheets

HINGE FOR MOUNTING A DOOR ON A FRAME

BACKGROUND OF THE INVENTION

1. Field of the Invention

The present invention relates to hinges and more particularly to a pre-mounting feature of a hinge for mounting a door on a frame.

2. Description of the Prior Art

Various types of hinges for mounting a door on a frame which are affixed to either the door or the frame by a variety of devices are known in the art. In my pending U.S. patent application Ser. No. 036,061, directed to an adjustable door hinge, I have provided a hinge arm with a substantially L-shaped or U-shaped hinge plate having a ledge with a depending edge which is receivable in a groove formed in the frame.

While improved hinges of the type disclosed in my pending application provide substantial gripping strength and hinge stability, the usefulness of such hinges is limited in that it is necessary to form a receiving groove in the frame, which requires an additional production step. Moreover, the grooved frame presents an unsightly appearance, and the groove decreases the relative strength of the frame.

The present invention addresses the deficiencies of the prior art hinges and provides a hinge which can be installed on a door or frame in a pre-mounting position for greater efficiency and reduced costs associated with production.

SUMMARY OF THE INVENTION

The general purpose of the present invention, which will be described subsequently in greater detail, is to provide a new and improved hinge for mounting a door on a frame which has all of, and more than the advantages, of prior an hinges and none of the disadvantages.

To attain this purpose, representative embodiments of the present invention are illustrated in the drawings. The hinge of the present invention makes use of a hinge arm receiver which is mountable on either a door or a frame and a hinge arm connected at one end to the hinge arm receiver and having at its other end a hinge plate with a depending ledge having a terminus portion. In order to install the hinge, for example, in the production of furniture articles such a desks or cabinets, the hinge is first mounted on a desk or cabinet door by affixing the hinge arm receiver to the inside of the door proximate a lateral edge of the door. The hinge plate is then received by the frame of the door opening of the desk or cabinet in a horizontal position of the desk or cabinet with the frame of the door opening facing upward. With the desk or cabinet so positioned, the terminus portion of the depending ledge of the hinge plate is engaged to the frame in a pre-mounting position of the hinge plate by frictional contact between the terminus portion and the frame. The hinge arm receiver connected to the door supports the door, and the frictional contact between the terminus portion and the frame is maintained by a pulling force exerted on the hinge arm transmitted through the hinge arm receiver affixed to the supported door. In order to enhance the frictional contact between the terminus portion of the depending ledge and the frame, the terminus portion may be configured as a bent portion of the depending ledge. Alternatively for such purpose, the terminus portion may be configured as a projection defined on the depending ledge, which may be hook-like.

For affixing the hinge plate to the frame, the hinge plate is provided with a top having at least one hole, and preferably a single slotted hole which enables adjustment of the position of the mounted hinge arm plate relative to the frame, for receiving a fastening screw. The fastening screw may be pre-mounted in the hole for increased efficiency of production. The hinge plate is moved from the pre-mounting position on the frame to a mounted position by simply tightening the fastening screw, for example, into a pre-drilled bore of the frame.

It will be appreciated that, for example, in an assembly line for the production of furniture articles such as desks or cabinets, after first mounting the hinge of the present invention on a door by affixing the hinge arm receiver to the door, a single worker may engage the hinge plate of the hinge to the desk or cabinet frame in a pre-mounting position, with the door affixed to and supported by the hinge arm receiver, and then affix the hinge plate to the frame by tightening the pre-mounted fastening screw. Thus, no assistance is required, for example, to hold the door in position while the hinge plate is moved from a pre-mounting position to a mounted position by tightening the fastening screw to affix the hinge plate to the frame.

While the hinge plate of the present invention may be configured in an L-shape with the hinge plate top forming the leg of the L-shape and the depending ledge forming the base of the L-shape, preferably the hinge plate is configured as a U-shape with the hinge plate top forming the base of the U-shape, the depending ledge forming one leg of the U-shape and a pair of depending legs opposite the depending ledge forming the other leg of the U-shape. The depending ledge and opposing pair of depending legs are relatively rigidly connected to the hinge plate top and are not easily deflectable. Thus, in order to facilitate movement of the hinge plate from the pre-mounting to the mounted position upon tightening the fastening screw and to accommodate the terminus portion of the depending ledge configured as a bent portion of the depending ledge or as a projection on the depending ledge, it is advantageous to provide an angle between the hinge plate top and the depending ledge which is greater than about 90 degrees.

This outline focuses on the more important features of the invention in order that a detailed description which follows may be better understood and in order that the present contribution to the art may be better appreciated. Them are, of course, additional features of the invention that will be described hereinafter and which will form the subject .matter of the claims appended hereto. It is understood that the invention is not limited in its application to the details of construction and to the arrangement of the components set forth in the following description and drawings. The invention is capable of other embodiments and of being practiced and being carried out in various ways.

It is to be further understood that the phraseology and terminology employed herein are the for the purpose of description and are not to be regarded as limiting. Those skilled in the art will appreciate that the conception upon which this disclosure is based may readily be utilized as a basis for designing the structures, methods, and systems for carrying out the several purposes of the present invention. The claims are regarded as including such equivalent constructions so long as they do not depart from the spirit and scope of the present invention.

From the foregoing summary, it is apparent that an object of the present invention is to provide a new and improved hinge for mounting a door on an frame which has all of, and more than, the advantages of prior art hinges and none of the disadvantages.

It is another object of the present invention to provide a new and improved hinge of the type described that is more reliable and functional than those presently available.

Yet another object of the present invention is to provide a hinge of the type described that simplifies installation by utilizing a hinge plate which can be engaged to a desk or cabinet frame in a pre-mounting position and affixed to the frame by tightening a pre-mounted fastening screw.

Still another object of the invention is to provide a hinge of the type described that has exceptional supporting capability associated with the hinge plate.

These, together with other objects of the present invention, along with the various features of novelty which characterize the invention, are pointed out with particularity in the claims annexed to and forming a part of this disclosure. For a better understanding of the invention, its operating advantages, and the specific objects attained by its uses, reference should be made to the accompanying drawings in which like characters of reference designate like parts throughout the several views.

BRIEF DESCRIPTION OF THE DRAWINGS

The invention will be better understood and objects other than those set forth above will become apparent when consideration is given to the following detailed description. Such description makes reference to the annexed drawings wherein.

DETAILED DESCRIPTION OF THE PREFERRED EMBODIMENT

Figure 1:
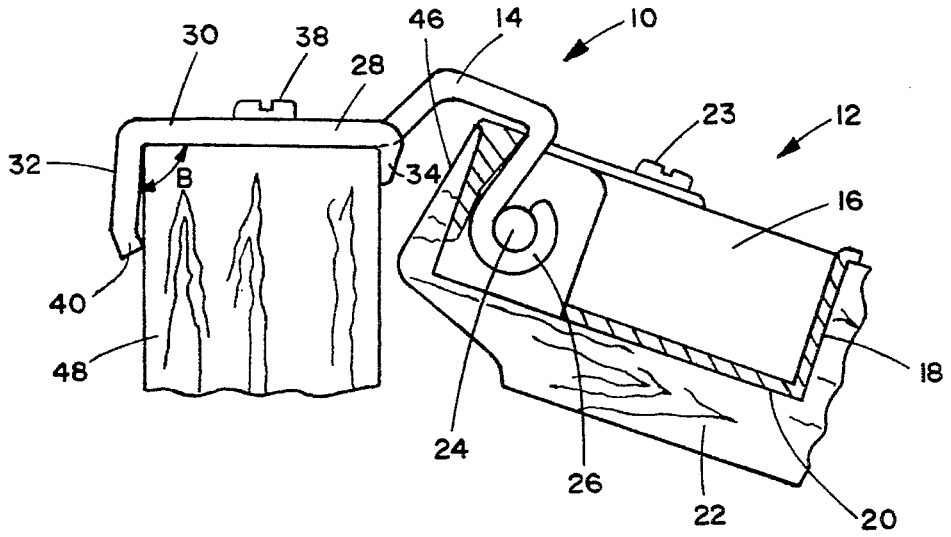
FIG. 1 is a side elevational, sectional, and fragmentary view of a hinge embodying the invention mounted on a door in connection with a frame with the hinge in the open position.

Referring now to the drawings and specifically to FIG. 1, the hinge for mounting a door on a frame shown generally as 10, has a hinge arm receiver shown generally as 12, to which a hinge arm 14 is connected. Hinge arm receiver 12 includes a hinge cup 16 and is mounted on door 22 by inserting hinge cup 16 into a bore defined by a substantially circular interior wall 18 and bottom 20 on the inside of door 22. Hinge arm receiver 12 is affixed to door 22 by fastening screw 23 inserted through a fastening screw hole defined in hinge arm receiver 12 into door 22. Hinge cup 16 carries a hinge pin 24 on which hinge arm 14 is pivoted at end 26, and hinge plate 28 is formed integrally on the opposing end of hinge arm 14. Preferably, hinge arm receiver 12 includes hinge cup 16 receivable in a bore on the inside of door 22, but hinge arm receiver 12 may with equal efficiency and effectiveness comprise components which are completely surface mounted.

Figure 2:
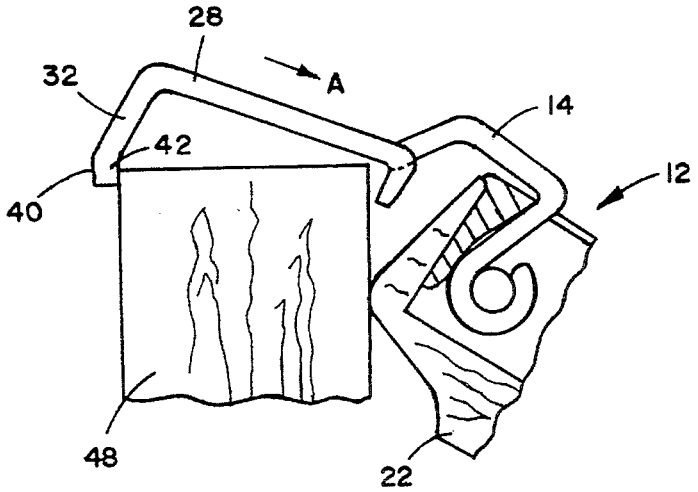
FIG. 2 is a side elevational, sectional, and fragmentary view of the hinge arm and hinge plate of the hinge shown in FIG. 1 in a pre-mounting position of the hinge plate on the frame.
Figure 4:
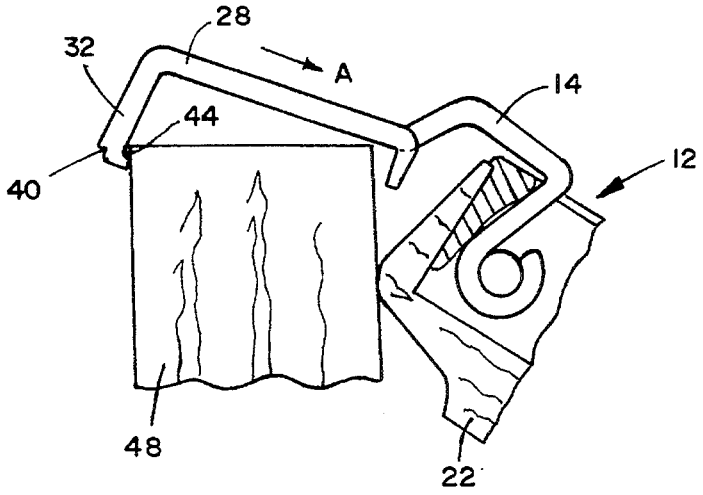
FIG. 4 is a side elevational, sectional, and fragmentary view of the hinge arm and hinge plate of the hinge shown in FIG. 3 in a pre-mounting position of the hinge plate on the frame.
Figure 5:
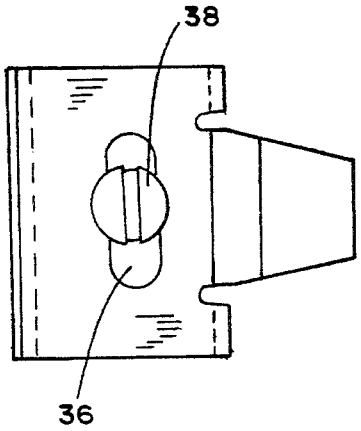
FIG. 5 is a plan view of the hinge arm and hinge plate shown in FIGS. 1 through 4.
Figure 6:
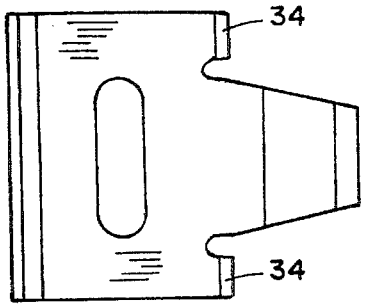
FIG. 6 is a bottom view of the hinge arm and hinge plate shown in FIGS. 1 and 2.
Figure 7:
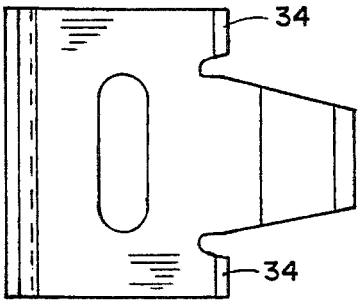
FIG. 7 is a bottom view of the hinge arm and hinge plate shown in FIGS. 3 and 4.

Hinge plate 28 includes a top 30, a depending ledge 32 and, preferably, a pair of depending legs 34 as shown in FIGS. 6 and 7 defining essentially a U-shape. Alternatively, depending legs 34 may be omitted, in which case top 30 and depending ledge 32 define essentially an L-shaped hinge plate. Top 30 of hinge plate 28 is provided with at least one slotted hole 36 for receiving a fastening screw 38 as shown in FIG. 5 which may be pre-mounted in slotted hole 36. Slotted hole 36 has a longitudinal axis extending parallel to the pivot axis of hinge pin 24 to enable displacement or repositioning of mounted door 22 relative to frame 48 by loosening fastening screw 38. Depending ledge 32 includes a terminus portion 40 which may be configured as a bent portion 42 of depending ledge 32 as shown in FIG. 2 or as a hook-like projection 44 formed on depending ledge 32 as shown in FIG. 4.

Hinge 10 may be installed in the production of a furniture article such as a desk or cabinet by first mounting hinge arm receiver 12 on door 22 and affixing hinge arm receiver 12 proximate lateral edge 46 with fastening screw 23. Hinge plate 28 is then received by frame 48 of a door opening of the desk or cabinet in a horizontal position of the desk or cabinet with frame 48 of the door opening facing upward. With frame 48 so positioned, terminus portion 40 of depending ledge 32 is engaged to frame 48 in a pre-mounting position of hinge plate 28 as shown in FIGS. 2 and 4 by frictional contact between terminus portion 40 and frame 48. For better frictional contact, terminus portion 40 may be configured as a bent portion 42 of depending ledge 32 or as a hook-like projection 44 formed on depending ledge 32. When so engaged, hinge arm receiver 12 connected to door 22 supports door 22, and the frictional contact between terminus portion 40 and frame 48 is maintained by a pulling force in the direction of arrow "A" as shown in FIGS. 2 and 4 exerted on hinge arm 14 transmitted through hinge arm receiver 12 affixed to supported door 22.

Figure 3:
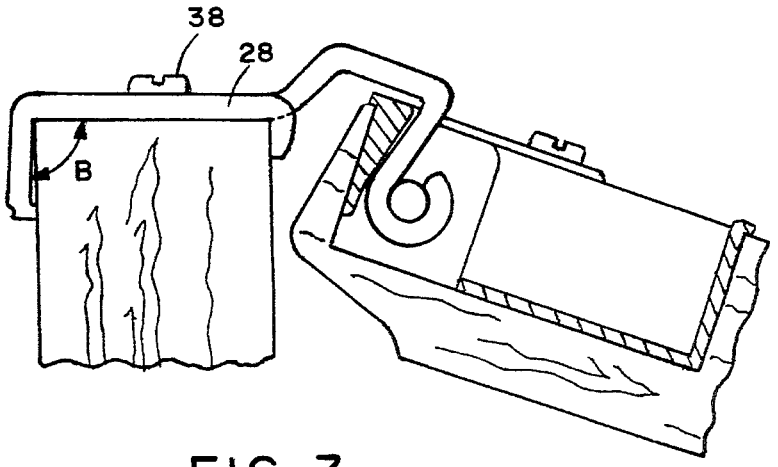
FIG. 3 is a side elevational, sectional, and fragmentary view of an alternative embodiment of the hinge embodying the invention mounted on a door in connection with a frame with the hinge in the open position.

Hinge plate 28 may then be affixed to frame 48 by tightening fastening screw 38 into frame 48, which may include a pre-drilled bore for receiving fastening screw 38. When fastening screw 38 is tightened, hinge plate 28 is moved from the pre-mounting position shown in FIGS. 2 and 4 to a mounted position of hinge plate 28 as shown in FIGS. 1 and 3. Hinge plate 28 including top 30, depending ledge 32 and depending legs 34 define essentially a U-shaped member to encompass the end and sides of frame 48 in the mounted position. Preferably, the space defined between terminus position 40 of depending ledge 32 is slight smaller than the space defined between the sides of frame 48 to provide gripping engagement.

In order to facilitate movement of hinge plate 28 from the pre-mounting position to the mounted position upon tightening fastening screw 38, depending ledge 32 may be configured to define an angle shown as "B" in FIGS. 1 and 3 of greater than about 90 degrees to accommodate terminus portion 40 of depending ledge 32 configured as bent portion 42 or as hook-like projection 44 on depending ledge 32. Preferably the angle is greater than about 90 degrees and less than about 100 degrees. Excellent results have been achieved with an angle of about 95 to 96 degrees.

While hinge arm 10 is shown installed with hinge arm receiver 12 mounted on door 22 and hinge plate 28 mounted on frame 48, it is to be understood that hinge 10 may likewise be installed with hinge arm receiver 12 mounted on frame 48 and hinge plate 28 mounted on door 22.

Obviously, any number of materials may be used to form the hinge and its components described herein, and exceptional success has been experienced by the use of metal material, although other materials such as rigid or semi-rigid plastic may be utilized.

With respect to the descriptions set forth above, optimum dimensional relationship for the parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein.

The foregoing is considered as illustrative only of the principles of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A hinge for mounting a door on a frame comprising: a hinge arm receiver mountable on one of the door and the frame; a hinge arm having first and second ends, the first end connected to the hinge arm receiver and the second end having a hinge plate mountable on the other of the door and frame and receivable by said other of the door and frame in pre-mounting and mounted positions, the hinge plate having a depending ledge with a terminus portion engageable by said other of the door and frame, said terminus portion being engageable in said pre-mounting position by frictional contact between said terminus portion and said other of the door and frame, said one of the door and frame being supportable on said mounted hinge arm receiver and said frictional contact being maintained by a pulling force exerted on said hinge arm transmitted through the connected hinge arm receiver supporting said one of the door and frame, said hinge plate having a top with portions defining at least one hole for receiving a fastening screw, said hinge plate being moveable from said pre-mounting position to said mounted position by fastening said received fastening screw to said other of said door and frame, said terminus portion of said depending ledge being configured as a bent portion of the depending ledge, and said depending ledge defining an angle with said hinge plate top which is greater than about 90 degrees.

2. The hinge as claimed in claim 1, wherein said angle is less than about 100 degrees.

3. A hinge for mounting a door on a frame comprising: a hinge arm receiver mountable on one of the door and the frame; a hinge arm having first and second ends, the first end connected to the hinge arm receiver and the second end having a hinge plate mountable on the other of the door and frame and receivable by said other of the door and frame in pre-mounting and mounted positions, the hinge plate having a depending ledge with a terminus portion engageable by said other of the door and frame, said terminus portion being engageable in said pre-mounting position by frictional contact between said terminus portion and said other of the door and frame, said one of the door and frame being supportable on said mounted hinge arm receiver and said frictional contact is maintained by a pulling force exerted on said hinge arm transmitted through the connected hinge arm receiver supporting said one of the door and frame, said hinge plate having a top with portions defining at least one hole for receiving a fastening screw, and said hinge plate being moveable from said pre-mounting position to said mounted position by fastening said received fastening screw to said other of the door and frame, said terminus portion of said depending ledge being configured as a projection defined on said depending ledge, said projection being hook-like, and said depending ledge defining an angle with said hinge plate top which is greater than about 90 degrees.

4. The hinge as claimed in claim 3 wherein said angle is less than about 100 degrees.

5. A hinge for mounting a door on a frame comprising: a hinge arm receiver mountable on one of the door and the frame; a hinge arm having first and second ends, the first end connected to the hinge arm receiver and the second end having a hinge plate mountable on the other of the door and frame and receivable by said other of the door and frame in pre-mounting and mounted positions, the hinge plate having a depending ledge with a terminus portion engageable by said other of the door and frame, said terminus portion being engageable in said pre-mounting position by frictional contact between said terminus portion and said other of the door and frame, said one of the door and frame being supported on said mounted hinge arm receiver and said frictional contact being maintained by a pulling force exerted on said hinge arm transmitted through the connected hinge arm receiver supporting said one of the door and frame, said hinge plate having a top with portions defining at least one hole for receiving a fastening screw, and said hinge plate being moveable from said pre-mounting position to said mounted position by fastening said received fastening screw to said other of the door and frame; and a hinge pin carried by said hinge arm receiver, said hinge arm first end being pivoted on said hinge pin, said at least one hole comprising a single slotted hole for receiving a single fastening screw, said single slotted hole having a longitudinal axis parallel to the pivot axis of said hinge pin, said hinge plate having a pair of depending legs opposite said depending ledge cooperatively engageable by said other of the door and frame in said mounted position of the hinge plate, said hinge plate top having opposing lateral edges, said single slotted hole being substantially centered between said lateral edges, and said depending ledge defining an angle with said hinge plate which is greater than about 90 degrees and less than about 100 degrees.

6. The hinge as claimed in claim 5, wherein said terminus portion of said depending ledge is configured as a bent portion of the depending ledge.

* * * * *